US005998712A

United States Patent [19]

Schmidt

[11] Patent Number: 5,998,712

[45] Date of Patent: Dec. 7, 1999

[54] STRINGED INSTRUMENT

[76] Inventor: Karlwalter Schmidt, Kapellenweg 19, D-88131, Lindau, Germany

[21] Appl. No.: 08/949,296

[22] Filed: Oct. 13, 1997

[30] Foreign Application Priority Data

Nov. 5, 1996 [DE] Germany ..... 196 45 533

[51] Int. Cl.[6] ..... G10D 3/00

[52] U.S. Cl. ..... 84/291; 84/294

[58] Field of Search ..... 84/291, 294, 290

[56] References Cited

U.S. PATENT DOCUMENTS 5,542,329 8/1996 Chen ..... 84/291

*Primary Examiner*—William M. Shoop, Jr.
*Assistant Examiner*—Shih-yung Hsieh
*Attorney, Agent, or Firm*—Ladas & Parry

[57] ABSTRACT

The sound box (3) of the stringed instrument surrounds components (6, 8), as a result of which the sound vibrations introduced by the playing strings (4, 5), across the bridge (1), on the top board (2) of the sound box (3) lead to oppositely directed or phase-displaced vibrations of the bottom wall (11). Thus, the pumping and sucking movement exerted by the vibrating (15) top board (2) on the air enclosed in the sound box (3) is supplemented by the sound vibrations of the bottom wall (11). The components enclosed for this purpose in the sound box (3) essentially comprise a lever (6) engaging on the top board (2) at two positions and located below the bridge (1), a support member (16) laterally supporting said lever on the sound box (3) and a supporting arch (8). Due to the fact that the lever (6) acts on the central region of the supporting arch (8), its ends engaging in the corner region between the bottom wall (11) and the peripheral wall (10) exert an expanding force leading to the upward movement of the arched bottom wall (11). Thus, the instrument is given a fuller, richer sound.

12 Claims, 2 Drawing Sheets

STRINGED INSTRUMENT

BACKGROUND OF THE INVENTION

The invention relates to a stringed instrument having a sound box, which is bounded upwardly by a top board and downwardly by an arched or planar bottom wall, in which the top board carries a string-supporting bridge and within the sound box are provided at least one lever at right angles to the direction of the strings and a supporting element, in order to transfer joint vibratory movements of the top board in phase-displaced manner to the bottom wall.

U.S. Pat. No. 5,542,329 discloses an instrument of this type, in which the lever and supporting elements provided within the sound box have the function of transferring vibrations acting from the strings, via the bridge onto the sound box top board from the latter to its bottom wall in such a way that the latter performs an oppositely directed or phase-displaced vibratory movement. This has the advantage that the pumping action of the top board acting inwardly on the air in the sound box is supplemented by the consequently simultaneously inwardly directed pumping movement of the bottom wall. However, it is disadvantageous that the sound box required stiffening ribs limiting its vibration capacity in order to absorb the elastic or tensional forces of the strings acting thereon via the bridge. It is also disadvantageous that the oscillations of the top board are only transferred through the components from one position to the bottom wall, so that tilting movements of the bridge in a direction at right angles to the strings lead to deformations to the top board, which have a disadvantageous influence on the sound evolution of the instrument.

The problem of the invention is to provide a stringed instrument of the aforementioned type which, whilst retaining a traditional external shape of the sound box, has a fuller and richer sound. The top board of the sound box, without overloading by the elastic force of the playing strings can be made thinner and therefore more vibratable and the bottom wall of the sound box can perform a relatively large vibratory movement opposing the vibration of the top board.

SUMMARY OF THE INVENTION

According to the invention this problem is solved in that, in the vicinity of the bridge, at at least two positions, the lever engages on or is fixed to the top board and whereof one position is in the area below the treble string and the other in the area below the bass or deep sound string, that part of the lever extends on the treble string side over and beyond the area of the bridge and is supported on the sound box directly or by means of a support member and that another part of the lever is supported on a supporting arch curved in the direction of the top board and also extending at right angles to the direction of the playing strings, the support point being located between the two positions where the lever engages on or is fixed to the top board and in which the two ends of the supporting arch extend in each case to the lateral marginal area of the bottom wall and are supported there directly or in each case by means of a support part, so that as a result of the force of the lever the supporting arch performs an elastic expanding or spreading movement.

BRIEF DESCRIPTION OF THE DRAWINGS

The invention is described in greater detail hereinafter relative to non-limitative embodiments and the attached drawings, wherein show.

DETAILED DESCRIPTION OF EMBODIMENTS

Figure 1:
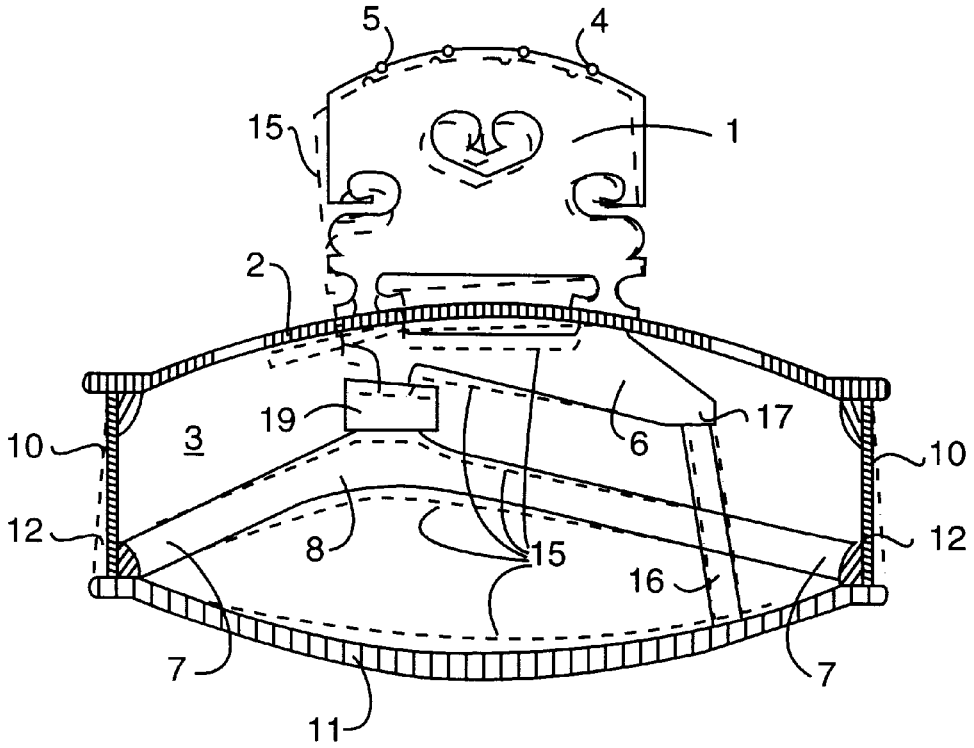
FIG. 1 A section through an instrument with an arched bottom wall, in the vicinity of the bridge and at right angles to the direction of the playing strings.
Figure 2:
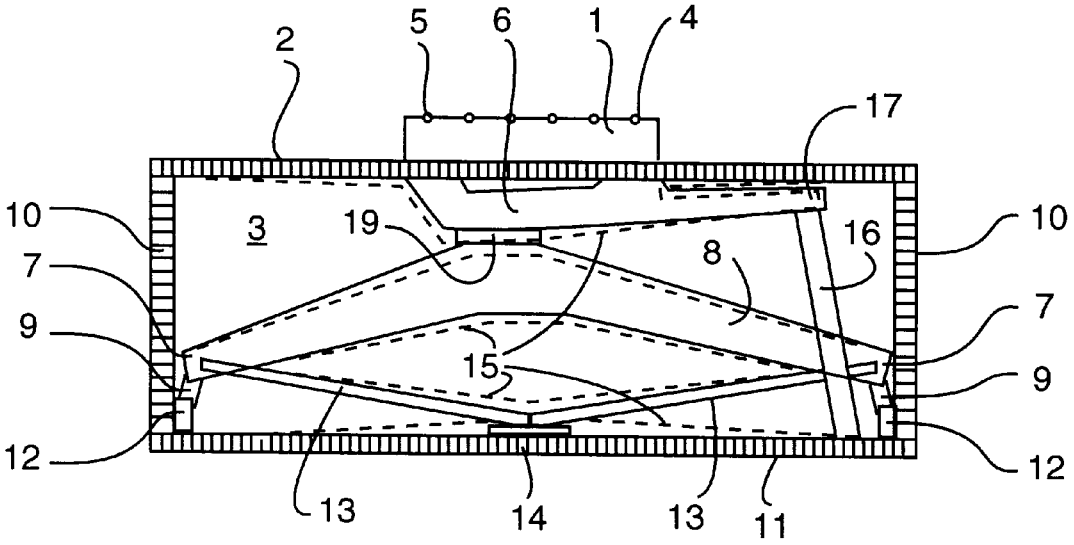
FIG. 2 A section through an instrument with a planar bottom wall.
Figure 3:
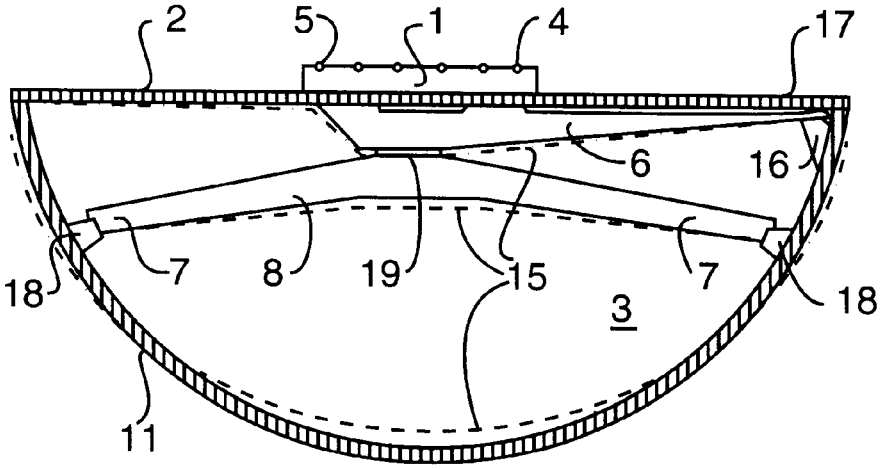
FIG. 3 A section through an instrument without a peripheral wall and with dish-shaped bottom wall passing up to the top board.

As can be gathered from the sectional representations of FIGS. 1 to 3, the stringed instrument has a bridge 1, which is supported on the top board 2 of a sound box 3 and over which pass the playing strings 4, 5 in the longitudinal direction of the stringed instrument.

For the nature of the implementation of the invention only the per se known cross-sectional shape of the sound box 3 has a particular significance and three examples thereof are shown in FIGS. 1 to 3. Thus, there is no need for a complete representation of an instrument in plan view, because the esthetic design preferably corresponds to that of known stringed instruments.

A lever 6 engages, at two positions, the inside of the top board 2, one position being located below the deep sound (bass) 5 and the other below the treble string 4. In the area between these two positions the lever 6 engages a supporting arch 8 curved upwards or towards the top board 2. Preferably at the bearing point between the two is provided a spacer 19, through whose thickness the magnitude of a pretension between the top board 2 and bottom wall 11 and consequently the sound behaviour of the instrument can be influenced.

A part of the lever 6 extending away from the side of the treble string 4 is supported at one end 17 thereof on a lateral area of the sound box 3 directly or by means of a support 16, so that on transferring sound vibrations from the strings 4, 5 via the bridge 1 and top board 2 to the supporting arch 8 the lever 6 performs a movement about such the support point.

The function of the supporting arch 8 is to exert, by means of its two ends 7, a spreading or expanding force, which through its direct or indirect action on the sound box 3 brings about a movement of the bottom wall 11 in such a way that said movement is in opposition to the top board 2 or is phase-displaced with respect thereto. The examples of FIGS. 1 and 3 illustrate how the expanding movement of the supporting arch 8 from the position represented in continuous lines to the position shown with dotted lines 15 in each case leads to an inward bending and consequently to a flattening of the bottom wall 11. As this movement is initiated by the simultaneous, vibratory inward movement of the top board 2, the sound box 3 undergoes a size decrease and increase in the manner of a bellows, corresponding to the sound vibrations. The air passing out through holes (not shown) in the top board 2, but conventionally existing in stringed instruments, consequently receives sound vibrations superimposed with those air or sound vibrations generated directly outwards by sound box vibration.

In the embodiment according to FIG. 1, the ends 7 of the supporting arch 8 are in each case supported in a corner region between the peripheral wall 10 and the bottom wall 11, so that the expanding movement of the supporting arch 8 leads to a stretching of the arched bottom wall 11.

In the embodiment according to FIG. 3 the expanding movement of the supporting arch 8 pushes the dish-shaped, rounded bottom wall 11 in its upper region in the outwards direction, so that its lower region moves inwards, as is shown by the dotted lines 15.

In the case of a planar or flat bottom wall 11, a spreading or expanding force acting directly thereon does not lead to a movement in opposition to that of the top board 2. In accordance with the embodiment according to FIG. 2, the ends 7 of the supporting arch 8 are fixed two connecting bars 13 leading to a central region of the bottom wall 11, so that said wall 11, during the expanding movement of the supporting arch 8, is drawn inwards (i.e. in a direction towards the top board 2,) as illustrated by the dotted lines 15. It is obvious that the two flat, inclined connecting bars 13 could be replaced by a similarly shaped, elastic connecting arch 13. In order to be able to absorb the force acting via the spacer 19 on the supporting arch 8 in the direction of the bottom wall 11, in this embodiment the ends 7 of the arch 8 are supported by means of shorter support members 9 in the corner region between the peripheral wall 10 and the bottom wall 11, so that it has an adequate distance from the bottom wall 11 for the arrangement of the flat, inclined connecting bars 13.

Instead of directly supporting of the ends 7 of the supporting arch 8 in the corner region on the bottom wall 11, as (shown in FIG. 1 the support of the ends 7 or the support members 9 (according to FIG. 2 ) preferably takes place on a lining 12 running in the longitudinal direction of the sound box 3, so that the supporting forces are longitudinally distributed. This force distribution function is fulfilled by a longitudinal rib 18 in the embodiment according to FIG. 3.

It is important in all embodiments of the invention that the supporting arch 8 and bottom wall 11 or the two connecting bars 13 or the connecting arch 13 fixed to the bottom wall jointly define a shape, which can be referred to as a rhombus or is comparable with the cross-sectional shape of a lens, so that an expansion leads to a flattening of said shape and consequently to an inward movement of the bottom wall 11.

At the connection point between the connecting bars 13 and the bottom wall 11 can be provided a spacing plate 14, whose thickness can be chosen so as to influence, in much the same way as with the spacer 19, the pretension between the parts and consequently the sound behaviour.

Figure 4:
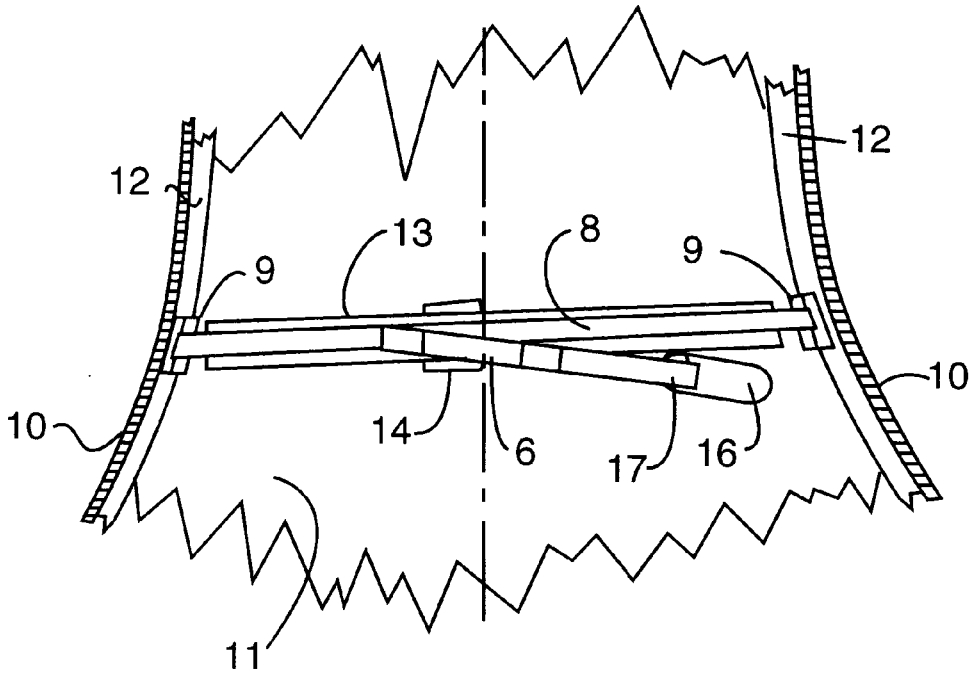
FIG. 4 A partial section through the sound box, e.g. of an instrument according to FIG. 1, parallel to the top board and with a plan view of components essential to the invention.

As can be gathered from FIG. 4, the flat lever 6 and the support member 16 in the same plane therewith can form an angle with the also flat supporting arch 8. In this way the distribution of the sound vibrations from the bridge 1, via the supporting arch 8 to the bottom wall 11 can be influenced. The areas of the lever 6 shown completely in black correspond to its application points in the areas below the bass string 5 and treble string 4.

What I claim is:

1. A stringed instrument with a sound box, which is upwardly defined by a top board and downwardly defined by a bottom wall, the top board carrying a bridge supporting playing strings and within the sound box are provided at least one lever and a supporting element, so as together to transfer vibratory movements of the top board in a phase-displaced manner to the bottom wall, wherein, in the vicinity of the bridge, at at least two positions, the lever engages the top board, whereof one position is in an area below the treble string and the other in an area below the bass string, that one part of the lever on one side of the treble string extends over and beyond the area of the bridge and is supported by the sound box and that another part of the lever is supported by the supporting element which is curved in the direction of the top board and extends at a right angle to the direction of the playing strings, the support point being located between the two positions where the lever engages the top board and in which two ends of the supporting element extend to a lateral marginal region of the bottom wall and are supported thereat, so that as a result of the tension of the lever the supporting element performs an elastic expanding movement.

2. The stringed instrument according to claim 1, wherein, the ends of the supporting member are supported by support parts located at the ends of the supporting element and are spaced a distance from the bottom wall (11) which at least approximately corresponds to the size of the curvature of the supporting element and including connecting members connecting to the ends of the supporting element to the central region of the bottom wall of the sound box.

3. The stringed instrument according to claim 2, wherein between the connecting bars and the bottom wall is provide a spacing plate whose dimensions define a pretension between the supporting element and the bottom wall.

4. The stringed instrument of claim 2 wherein a spacing plate is interposed between the connecting members and the bottom wall of the sound box.

5. The stringed instrument according to claim 1, wherein between the lever and the supporting element is provided a spacer, whose size defines a pretension acting between the top board and the bottom wall.

6. The stringed instrument according to claim 1, wherein, in a viewing direction perpendicular to the bottom wall, the lever and the supporting element define an angle.

7. The stringed instrument according to claim 1, in which the top board and an outwardly curved bottom wall of the sound box are interconnected by a peripheral wall, wherein the ends of the supporting element are in each case supported in the corner region between the bottom wall and the peripheral wall.

8. The stringed instrument of claim 1 wherein the supporting element is arch-shaped.

9. A stringed instrument comprising:

a sound box;

a bridge, disposed on the sound box, for supporting playing strings;

a lever disposed in the sound box in the vicinity of the bridge, the lever having two ends, one end engaging a top element of the sound box in an area below the treble playing string and the other end engaging the top element of the sound box in an area below the bass playing string;

a supporting element which supports the lever at a location between the two ends thereof, the supporting element having two ends which extend toward marginal regions of a bottom element of the sound box and which are supported thereat, whereby tensioning of the lever causes the supporting element to make an elastic expanding movement deflecting the bottom element.

10. The stringed instrument of claim 9 wherein the supporting element is arch-shaped.

11. The stringed instrument of claim 9 wherein a spacer is interposed between the lever and the supporting element.

12. The stringed instrument of claim 9 further including connecting members connecting to the ends of the supporting element to the central region of a bottom wall of the sound box.

* * * * *